US012546212B2

(12) United States Patent
Oviedo Gutierrez et al.

(10) Patent No.: US 12,546,212 B2
(45) Date of Patent: Feb. 10, 2026

(54) SYSTEMS AND METHODS FOR PROVIDING A USER INTERFACE FOR AUTOMATION WORKFLOWS FOR CONTROLLING THROUGH-THE-BIT APPLICATIONS

(71) Applicant: Schlumberger Technology Corporation, Sugar Land, TX (US)

(72) Inventors: Tania Maria Oviedo Gutierrez, Houston, TX (US); Kapil Sinha, Calgary (CA); James Tran, Sugar Land, TX (US); Olubunmi Adeyemi, Sugar Land, TX (US); Nadiia Shafarenko, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/123,408

(22) PCT Filed: Dec. 18, 2023

(86) PCT No.: PCT/US2023/084575
§ 371 (c)(1),
(2) Date: Apr. 23, 2025

(87) PCT Pub. No.: WO2024/130240
PCT Pub. Date: Jun. 20, 2024

(65) Prior Publication Data

US 2026/0009327 A1 Jan. 8, 2026

Related U.S. Application Data

(60) Provisional application No. 63/387,768, filed on Dec. 16, 2022.

(51) Int. Cl.

| | |
|---|---|
| ***E21B 47/12*** | (2012.01) |
| ***E21B 44/00*** | (2006.01) |
| ***E21B 47/04*** | (2012.01) |

(52) U.S. Cl.
CPC ..... *E21B 47/138* (2020.05); *E21B 44/00* (2013.01); *E21B 47/04* (2013.01)

(58) Field of Classification Search
CPC ..... E21B 47/12; E21B 17/028; E21B 49/00; E21B 47/26; E21B 2200/20; E21B 47/135; E21B 47/138; E21B 44/00; E21B 47/04
See application file for complete search history.

(56) References Cited

U.S. PATENT DOCUMENTS

| | | | |
|---|---|---|---|
| 2013/0186687 A1 | 7/2013 | Snyder | |
| 2015/0015412 A1 | 1/2015 | Abbassian | |

(Continued)

FOREIGN PATENT DOCUMENTS

| | | | | |
|---|---|---|---|---|
| CA | 2899975 A1 * | 10/2014 | ..... | G06F 17/40 |
| CA | 3014293 C * | 11/2019 | ..... | G06F 30/20 |
| WO | 2011014912 A1 | 2/2011 | | |

OTHER PUBLICATIONS

International Search Report and Written Opinion of International Patent Application No. PCT/US2023/084575 dated on Apr. 22, 2024, 12 pages.

*Primary Examiner* — Zakiya W Bates
(74) *Attorney, Agent, or Firm* — Jeffrey D. Frantz

(57) ABSTRACT

Systems and methods include a user interface for automation workflows for controlling through-the-bit applications. For example, a method includes communicatively coupling to a memory media of a downhole tool; and providing, via a data processing system, a user interface to enable a user to manipulate data relating to downhole operations performed by the downhole tool, and to format the memory media of the downhole tool. Different views of the user interface may enable the presentation of a pre-job surface check workflow, (Continued)

a depth acquisition workflow, and a data quality check workflow, among other workflows.

10 Claims, 24 Drawing Sheets

(56) References Cited

U.S. PATENT DOCUMENTS

| | | | |
|---|---|---|---|
| 2016/0203681 | A1 | 7/2016 | Nield |
| 2020/0370381 | A1 | 11/2020 | Al-Rubaii |

* cited by examiner

SYSTEMS AND METHODS FOR PROVIDING A USER INTERFACE FOR AUTOMATION WORKFLOWS FOR CONTROLLING THROUGH-THE-BIT APPLICATIONS

CROSS-REFERENCE TO RELATED APPLICATIONS

The present application is a National Stage Entry of International Application No. PCT/US2023/084575, filed on Dec. 18, 2023, that claims priority to U.S. Provisional Patent Application No. 63/387,768 that was filed on Dec. 16, 2022, which is herein incorporated by reference in its entirety.

FIELD

The present disclosure generally relates to systems and methods for providing a user interface for automation workflows for controlling through-the-bit applications.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

Downhole operations, including through-the-bit drilling operations, utilize certain downhole tools that facilitate the operations. Such downhole tools include memory media that are used to store data relating to the downhole operations, such as data acquired during the downhole operations as well as data relating to how the downhole tools operate during the downhole operations. In general, interfacing with and configuring such memory media can often be relatively cumbersome.

SUMMARY

A summary of certain embodiments described herein is set forth below. It should be understood that these aspects are presented merely to provide the reader with a brief summary of these certain embodiments and that these aspects are not intended to limit the scope of this disclosure.

Certain embodiments of the present disclosure include a method that includes communicatively coupling to a memory media of a downhole tool; and providing, via a data processing system, a user interface to enable a user to manipulate data relating to downhole operations performed by the downhole tool, and to format the memory media of the downhole tool.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

Figure 1:
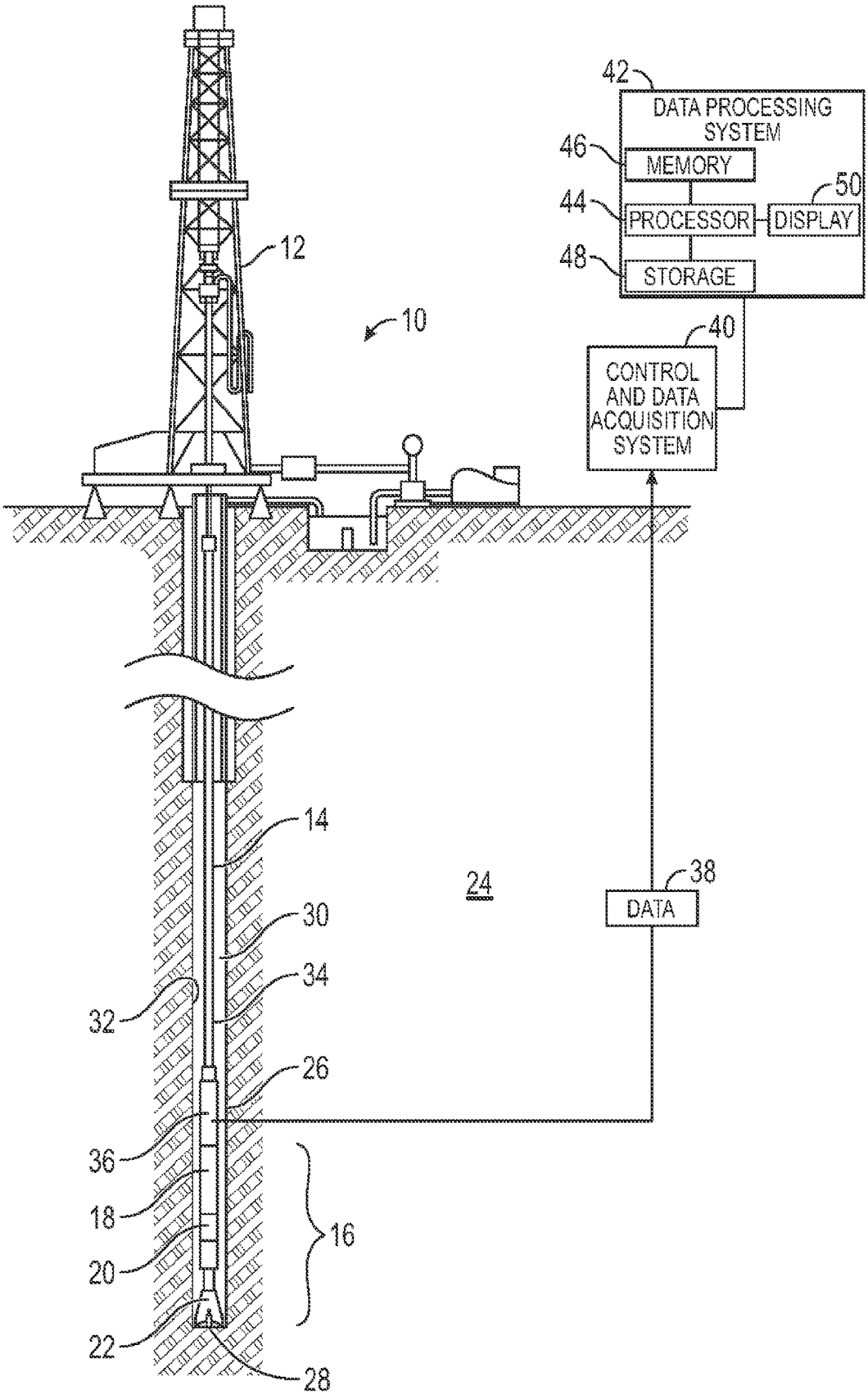
FIG. 1 illustrates an example downhole drilling system, in accordance with embodiments of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole", "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

In addition, as used herein, the terms "real time", "real-time", or "substantially real time" may be used interchangeably and are intended to describe operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequent, during operations of the systems (e.g., while the systems are operating). In addition, as used herein, the terms "automatic" and "automated" are intended to describe operations that are performed or caused to be performed, for example, by a processing/control system (i.e., solely by the processing/control system, without human intervention).

The embodiments described herein generally include systems and methods for providing a user interface for automation workflows for controlling through-the-bit applications. For example, a method includes communicatively coupling to a memory media of a downhole tool; and providing, via a data processing system, a user interface to enable a user to manipulate data relating to downhole operations performed by the downhole tool, and to format the memory media of the downhole tool. Different views of the user interface may enable the presentation of a pre-job surface check workflow, a depth acquisition workflow, and a data quality check workflow, among other workflows.

Referring now to FIG. 1, an example downhole drilling system 10 includes a rig 12, a drill string 14, and a bottom hole assembly (BHA) 16 including drill collars 18, stabilizers 20, and the drill bit 22. With force or weight applied to the drill bit 22 via the drill string 14, the rotating drill bit 22 engages the geological formation 24 and proceeds to form a borehole 26 along a predetermined path toward a target zone in the formation 24. In certain embodiments, drilling fluid or mud pumped down the drill string 14 passes out of the drill bit 22 through nozzles positioned in the drill bit 22. The drilling fluid cools the drill bit 22 and flushes cuttings away from the face of drill bit 22. The drilling fluid and cuttings are forced from the bottom 28 of the borehole 26 to the surface through an annulus 30 formed between the drill string 14 and the borehole sidewall 32. In certain embodiments, interior profiles 34 may be positioned in any tubular in the borehole 26 or in the borehole sidewall 32.

In certain embodiments, a downhole tool 36 may be lowered into and suspended inside the drill string 14 or another tubular member by a suspension element (e.g., a wireline or slickline cable). In other embodiments, the downhole tool 36 may be coupled to a pump down sub (not shown) and wirelessly lowered into and suspended inside the drill string 14 by way of pumping against the pump down sub. In addition, in certain embodiments, the suspension element and downhole tool 36 may optionally be configured to pass into the borehole 26 beyond the drill bit 22, for instance when a portion of the drill bit 22 is opened to allow passage of the downhole tool 36 through the drill bit 22. The downhole tool 36 may collect a variety of data 38 that may be stored and processed downhole or, as illustrated in FIG. 1, may be sent to the surface for processing. In certain embodiments, the data 38 may be sent via a control and data acquisition system 40 to a data processing system 42. The control and data acquisition system 40 may receive the data 38 in any suitable manner. For example, in certain embodiments, the control and data acquisition system 40 may transfer the data 38 via electrical signals pulsed through the geological formation 24 or via mud pulse telemetry using the drilling fluid. In other embodiments, the data 38 may be retrieved directly from the downhole tool 36 upon return to the surface.

In certain embodiments, the data processing system 42 may include at least one processor 44, memory 46, storage 48, and/or a display 50. The data processing system 42 may use the data 38 to determine various properties of the well using any suitable techniques. To process the data 38, the at least one processor 44 may execute instructions stored in the memory 46 and/or storage 48. As such, the memory 46 and/or the storage 48 of the data processing system 42 may be any suitable article of manufacture that can store the instructions. The memory 46 and/or the storage 48 may be ROM memory, random-access memory (RAM), flash memory, an optical storage medium, or a hard disk drive, to name but a few examples. The display 50 may be any suitable electronic display that can display logs and/or other information relating to properties of the well as measured by the downhole tool 36. It will be appreciated that, although the data processing system 42 is shown by way of example as being located at the surface, at least part of the data processing system 42 may be located in the downhole tool 36. In such embodiments, some of the data 38 may be processed and stored downhole, while some of the data 38 may be sent to the surface in substantially real time.

In certain embodiments, the tool string illustrated in FIG. 1 may be operated in wireline mode or in memory mode, and its main application may be to enable generation of pump-down logs through for the fluid being pumped down through the drill pipe. In this mode of operation, the tool string is deployed via a wireline cable and pumped to the bottom of the drill pipe (e.g., to allow reaming before the tool string is pumped down). The tool string exits the bottom of the drill pipe and is caught by a no-go just above the drill bit 22. Once correct operation of the tool string is confirmed, in certain embodiments, the tool string may be dropped off using an electrical drop-off tool at the top of the string to continue operation in memory mode, and the wireline cable may then be retrieved.

At this point, the log may then be run while drill pipe is pulled. At the top log interval, wireline may be run downhole again and the tool string may be retrieved, while the drill pipe remains downhole. When the tool string arrives at the surface, recorded data may be downloaded from the downhole tool 36, and graphical logs/digital log interface standard (DLIS) files may be generated. In addition, as described in greater detail herein, automated wellsite job execution software for through-the-bit operations may be provided by the data processing system 42, wherein the automated wellsite job execution software focuses on: (1) pre-job surface checks, (2) depth acquisition and correction, and (3) data download and analysis, among other features.

Figure 2:
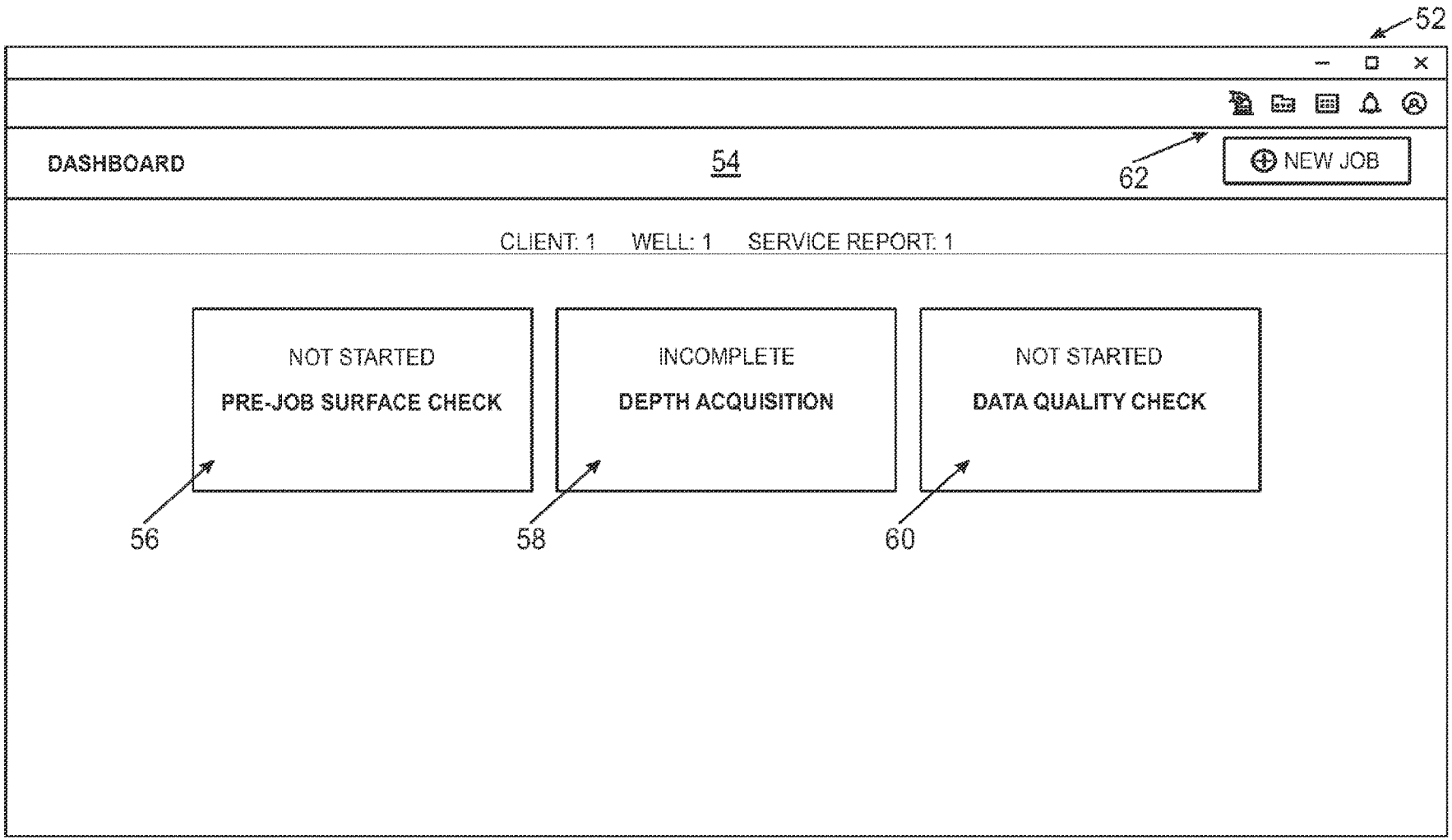
FIG. 2 illustrates a graphical user interface of automated wellsite job execution software having a dashboard view enabling selection of various workflows relating to analysis and formatting of memory media of a downhole tool, in accordance with embodiments of the present disclosure.
Figure 3:
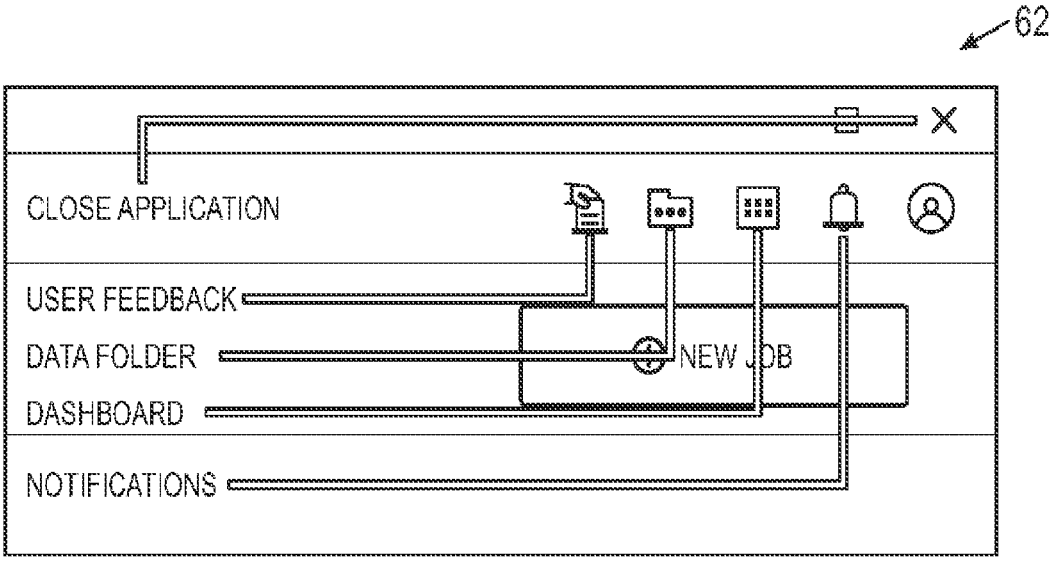
FIG. 3 illustrates a toolbar of the graphical user interface of FIG. 2, in accordance with embodiments of the present disclosure.

FIG. 2 illustrates a graphical user interface 52 of the automated wellsite job execution software described herein, which enables three main workflows for through-the-bit wellsite automation. Specifically, as illustrated in FIG. 2, the graphical user interface 52 may present a dashboard view 54 that enables three workflows of: (1) pre-job surface check 56, (2) depth acquisition 58, and (3) data quality check 60. In addition, as also illustrated in FIG. 2, a toolbar 62 in the top right hand corner of the dashboard view 54 enables basic operations not specific to any of the three workflows 56, 58, 60. For example, as illustrated in FIG. 3, in certain embodiments, the toolbar 62 may enable a user to: (1) close the application (i.e., the graphical user interface 52), (2) provide user feedback, (3) access a data folder (e.g., on data file directory), (4) make the dashboard view 54 viewable (e.g., from other views presented via the graphical user interface 52, which will be described in greater detail herein), and (5) view notifications, among other basic operations.

Pre-Job Surface Check

Figure 4:
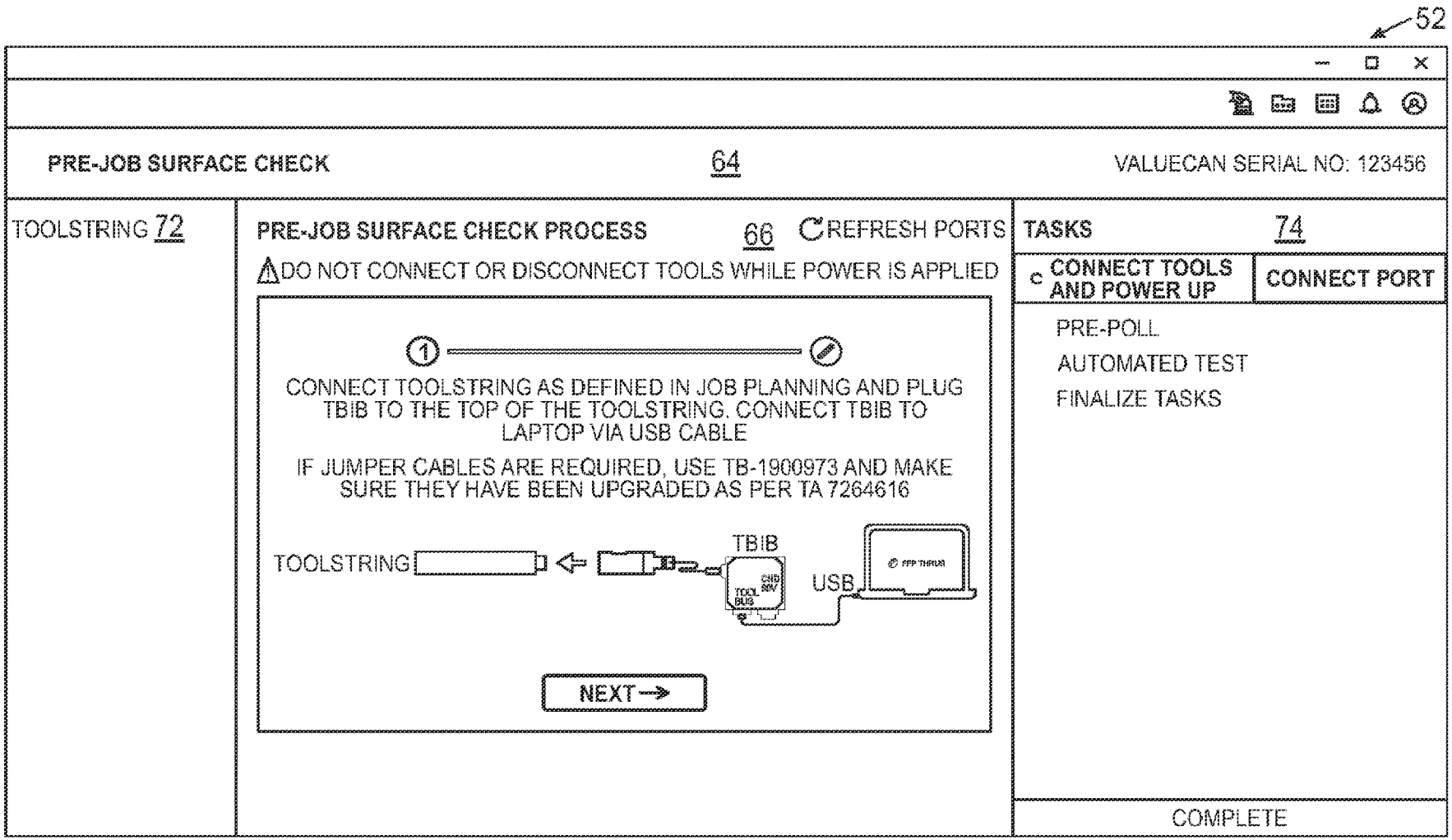
FIGS. 4-9 illustrate various views of a pre-job surface check workflow that may be initiated from the dashboard view illustrated in FIG. 2, in accordance with embodiments of the present disclosure.

As illustrated in FIG. 4, if a user selects the pre-job surface check 56 option from the dashboard view 54 illustrated in FIG. 2, in response, the graphical user interface 52 may present a pre-job surface check view 64. As also illustrated in FIG. 4, in certain embodiments, the pre-job surface check view 64 may display dynamic standard work instructions (SWIs) 66 by default in each of the workflows 56, 58, 60 to help the user with physically connecting the downhole tools 36 (e.g., using cables) to the data processing system 42, the control and data acquisition system 40, and/or a separate computer being used by the user to view the graphical user interface 52. As illustrated in FIG. 4, in certain embodiments, each step of the SWIs 66 may include drawings and descriptions that are integrated with the relevant steps in the software that needs to be performed.

Figure 5:
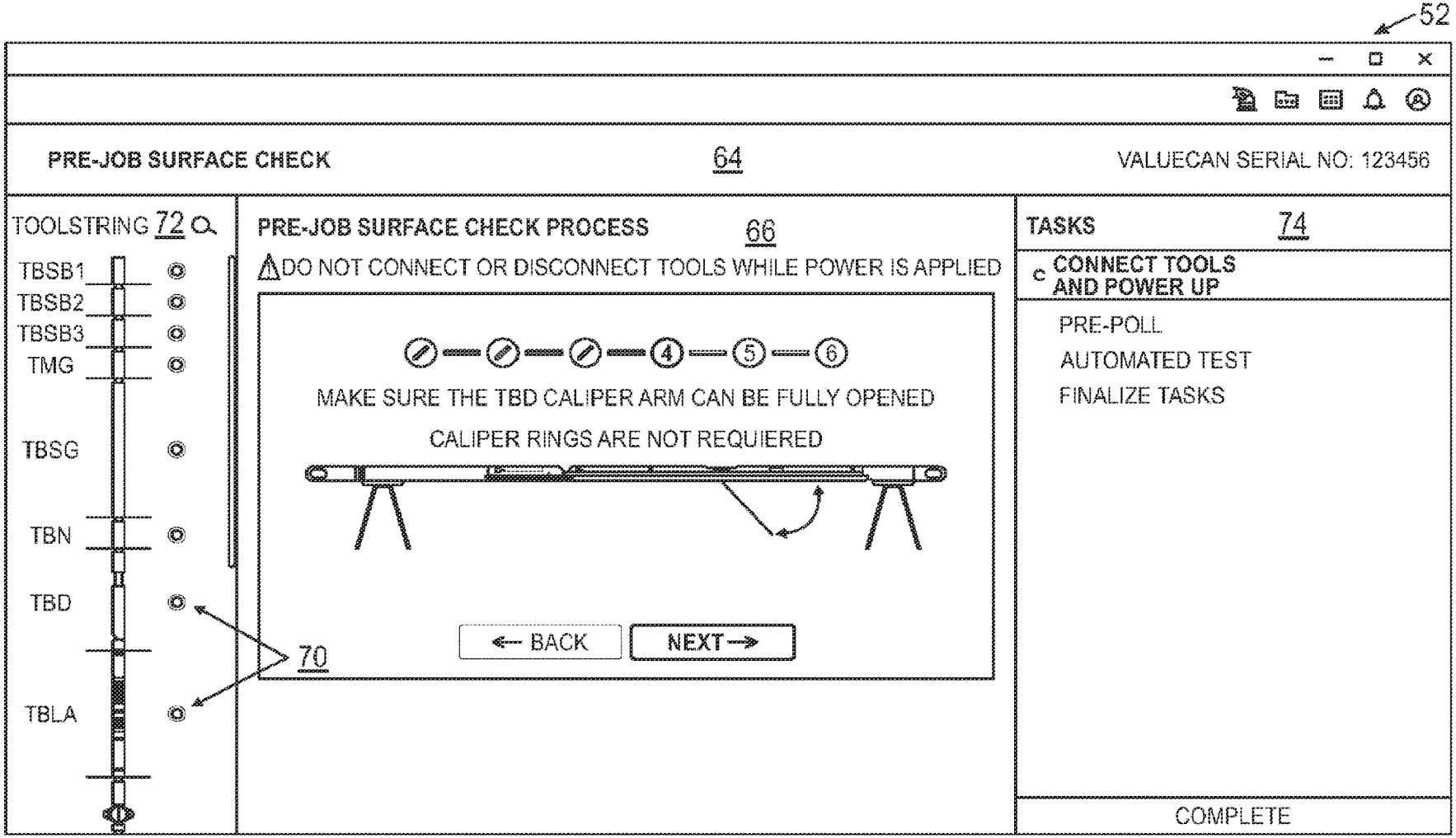
Figure 6:
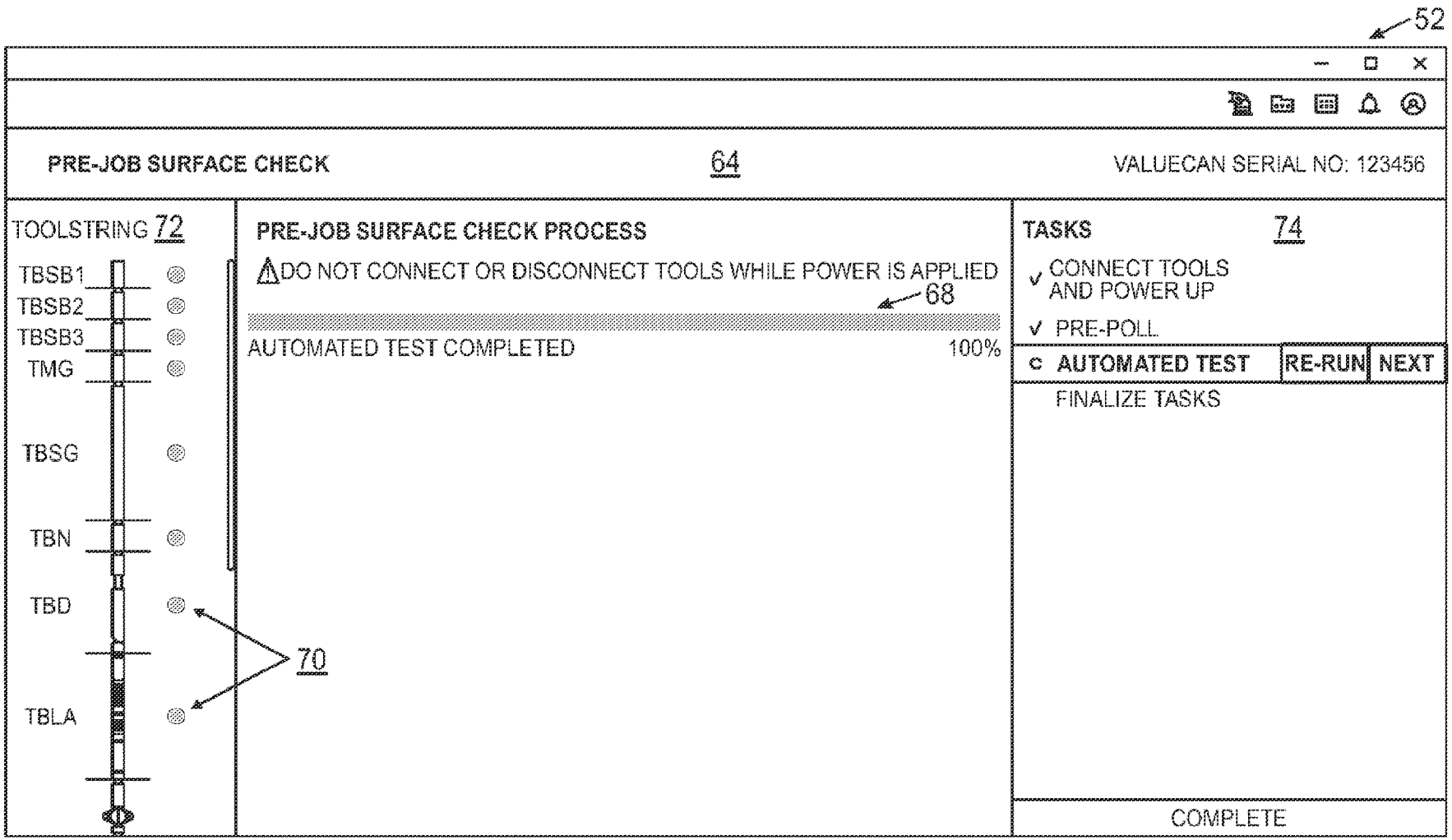

As illustrated in FIG. 5, in certain embodiments, once the cables are connected and the downhole tools 36 are powered up, the software detects the downhole tools 36 that are connected and dynamically updates the SWIs 66 based on what downhole tools 36 are available (e.g., a TBD caliper in the illustrated embodiment). In addition, as illustrated in FIG. 6, in certain embodiments, once the tests are started, a progress bar 68 may show the progress of the automated tests (e.g., to test various functionalities of individual components of the downhole tools 36) and traffic lights 70 on a toolstring pane 72 may show the collective results of all the tests. In addition, in certain embodiments, a tasks pane 74 may show what steps have been done, and which tasks are left to be performed.

Figure 7:
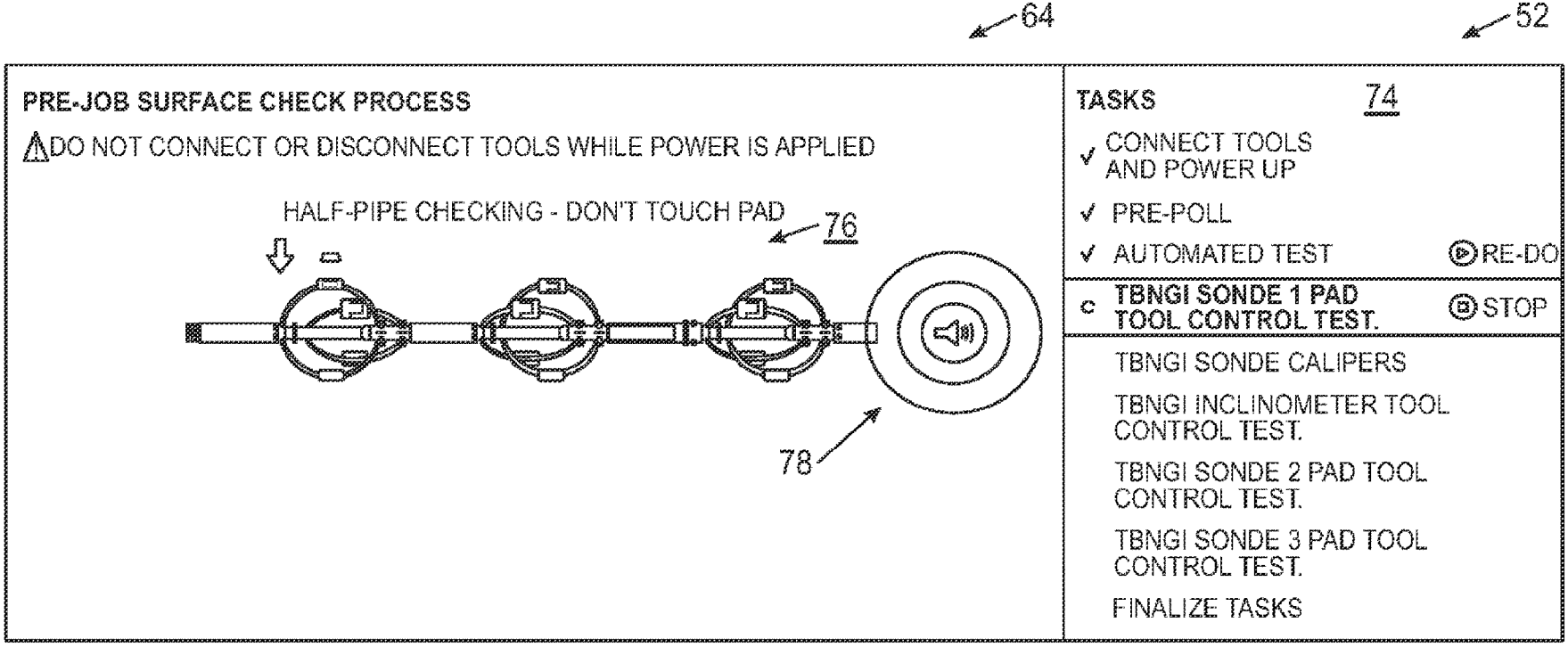
Figure 8:
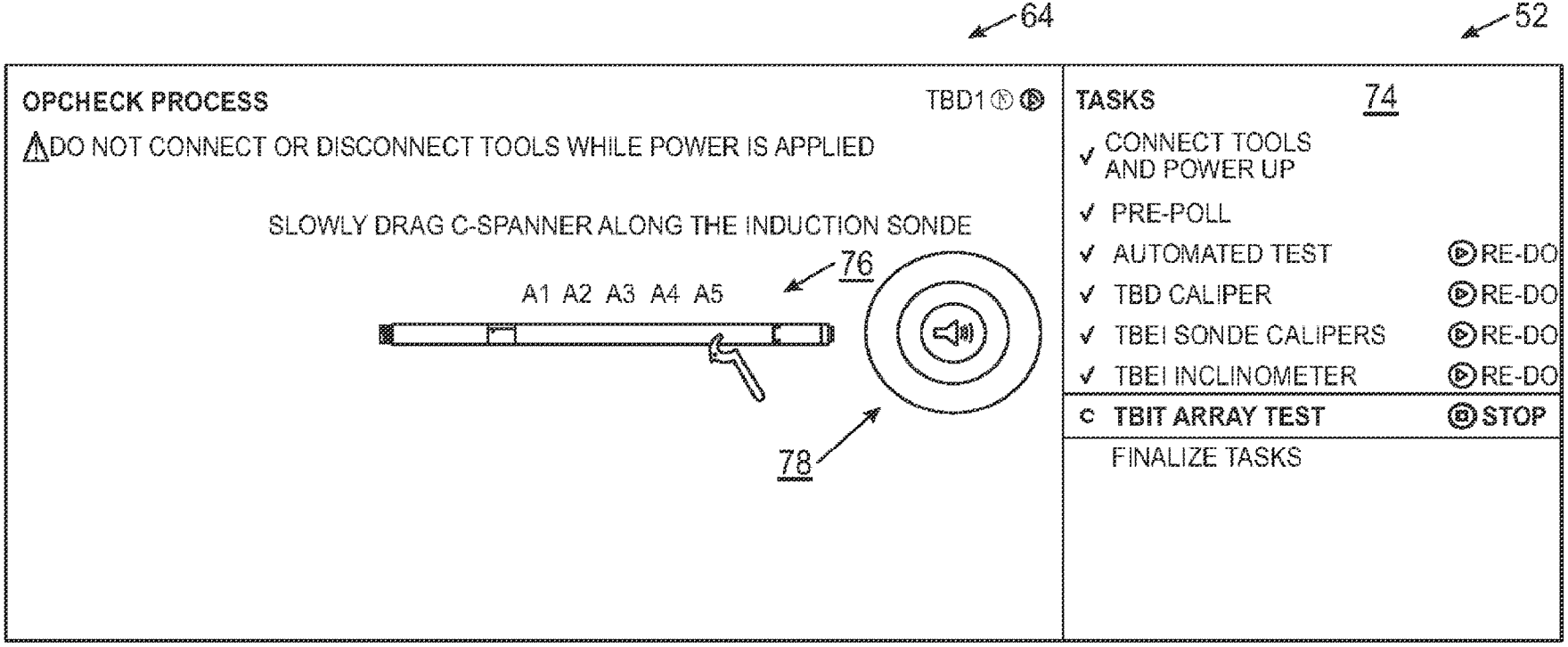
Figure 9:
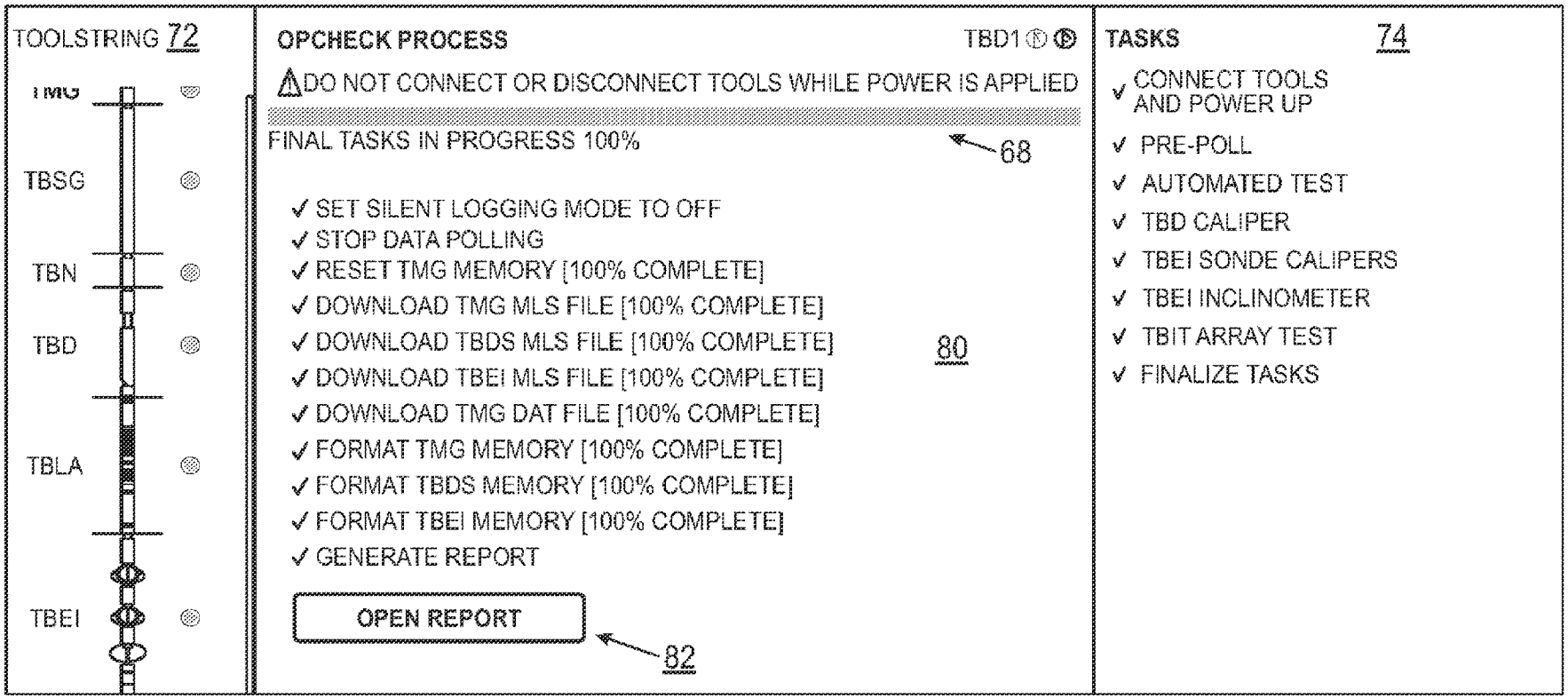

Some tests are not fully automated due to safety concerns, or they require a user to perform mechanical movements on a downhole tool 36 while the software monitors the signal response. As illustrated in FIGS. 7 and 8, user-guided tests may be aided by animated drawings 76 that instruct the user on what to do. While the user is performing the test on the downhole tools 36 and are away from the computer screen, audio cues (and, in certain embodiments, audio speech instructions) 78 may be played on the computer to update the user on the progress and the next steps. As illustrated in FIG. 9, in certain embodiments, a final tasks pane 80 may show the preparation for the downhole tool 36 to be run downhole, as illustrated in FIG. 1. In addition, a test report may be provided after all tasks are completed by, for example, clicking on an Open Report button 82 displayed in the final tasks pane 80.

Depth Acquisition

Figure 10:
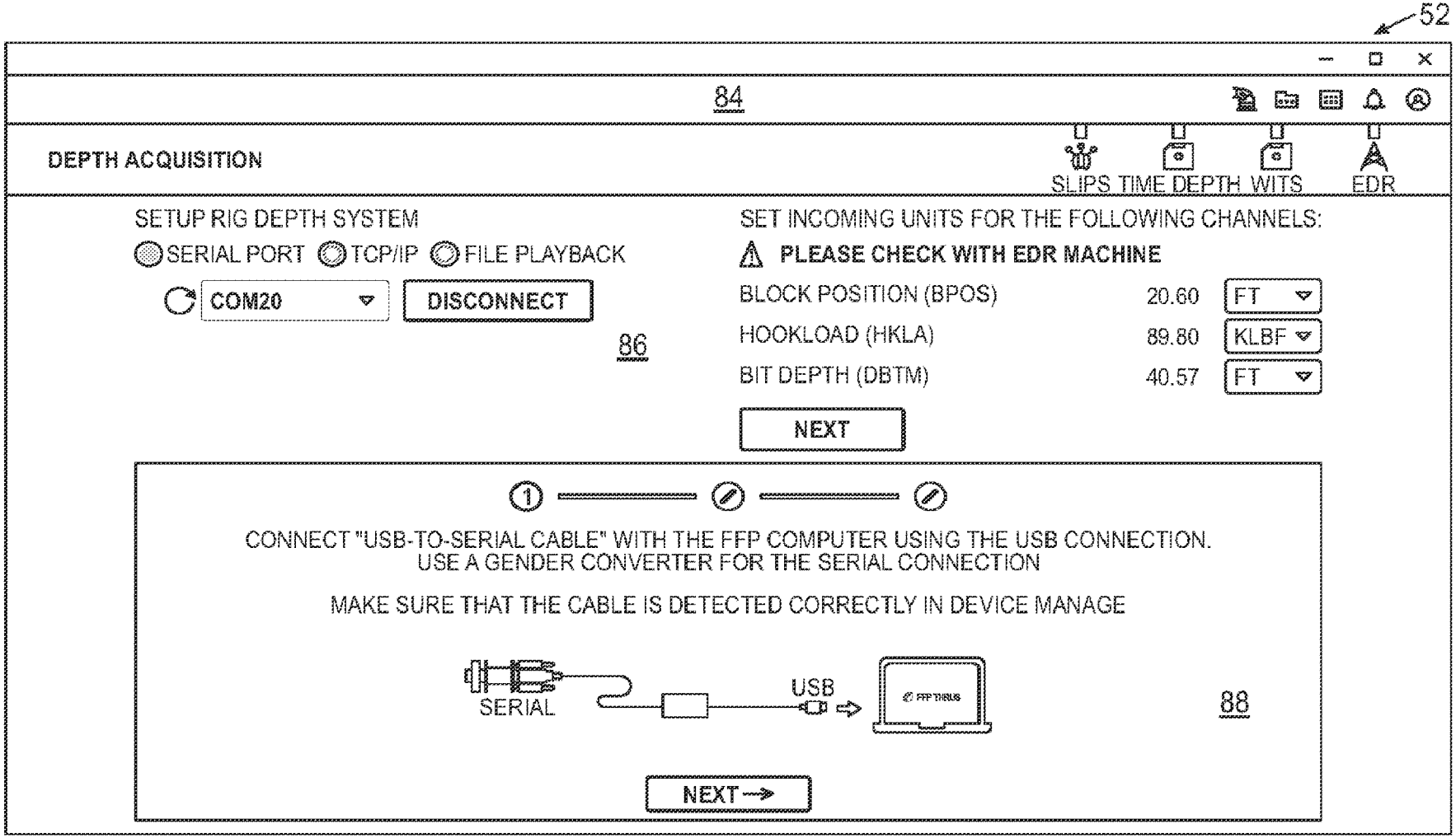
FIGS. 10-14 illustrate various views of a depth acquisition workflow that may be initiated from the dashboard view illustrated in FIG. 2, in accordance with embodiments of the present disclosure.

As illustrated in FIG. 10, if a user selects the depth acquisition 58 option from the dashboard view 54 illustrated in FIG. 2, in response, the graphical user interface 52 may present a depth acquisition view 84. As also illustrated in FIG. 10, in certain embodiments, the depth acquisition view 84 may display setup options in a setup options pane 86 along with dynamic SWI changes in an SWI changes pane 88, which are determined based on what the user selects from the setup options.

Figure 11:
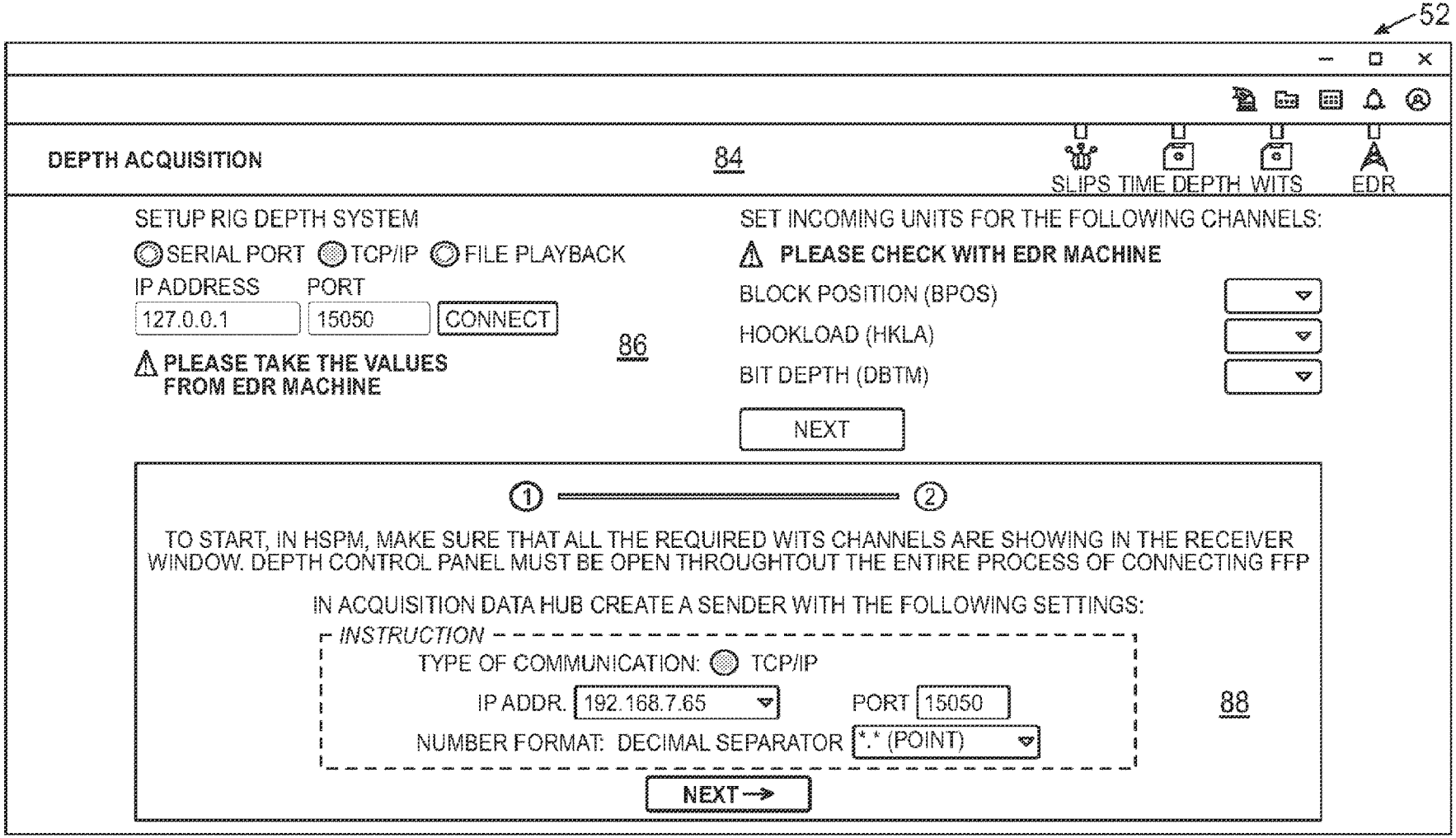
Figure 12:
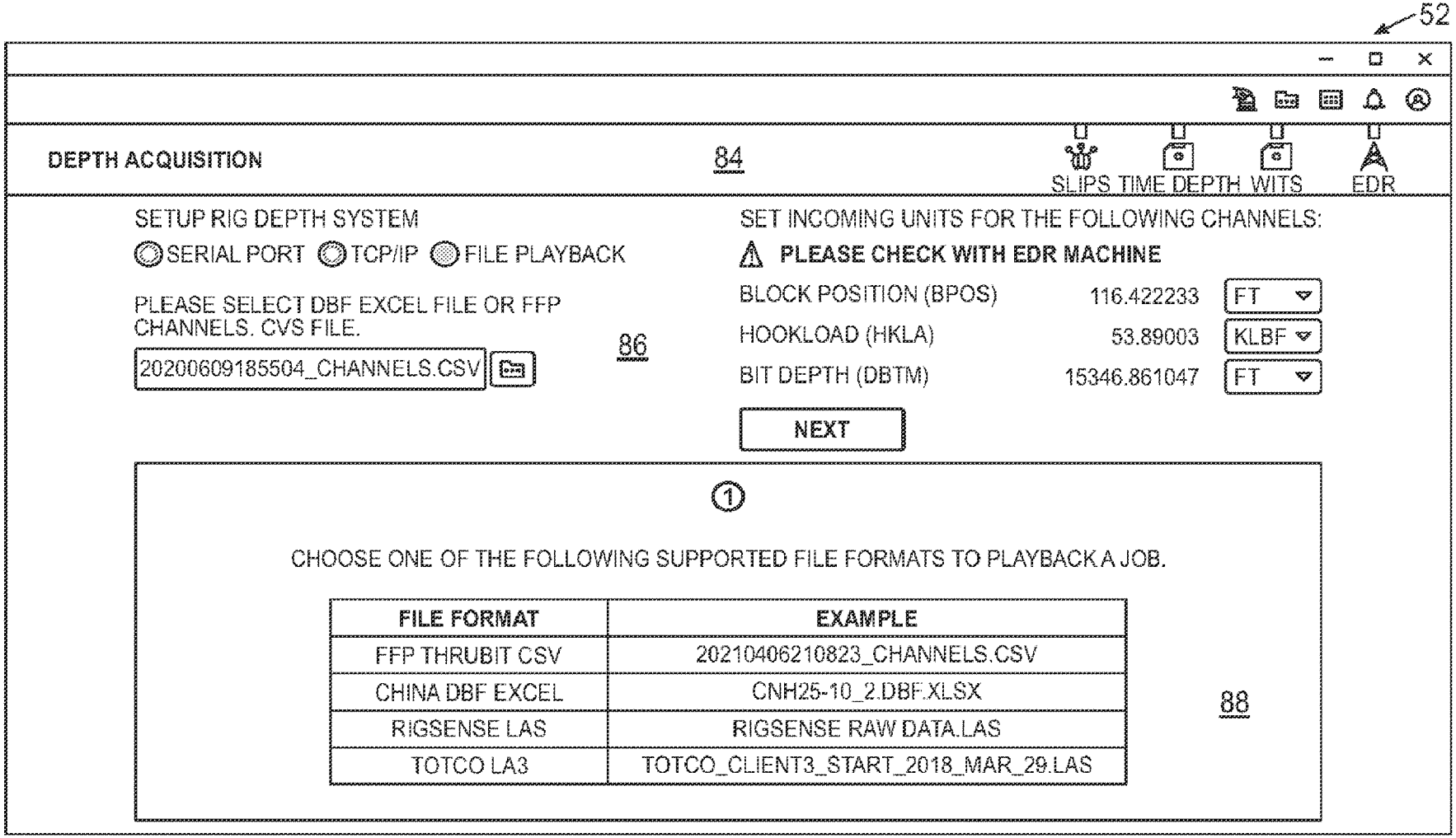

As illustrated in FIG. 10, in certain embodiments, for serial port connections, the dynamic SWIs may show how to connect the cable and, for example, an adapter from a third-party computer. Alternatively, as illustrated in FIG. 11, in certain embodiments, for TCP/IP connections, the dynamic SWIs may show how to setup certain software (e.g., Horizon Signal Processing Module (HSPM), in certain embodiments) to connect. As illustrated in FIG. 12, in certain embodiments, for File Playback, the dynamic SWIs may show a list of supported file formats that can be loaded and played back.

Figure 13:
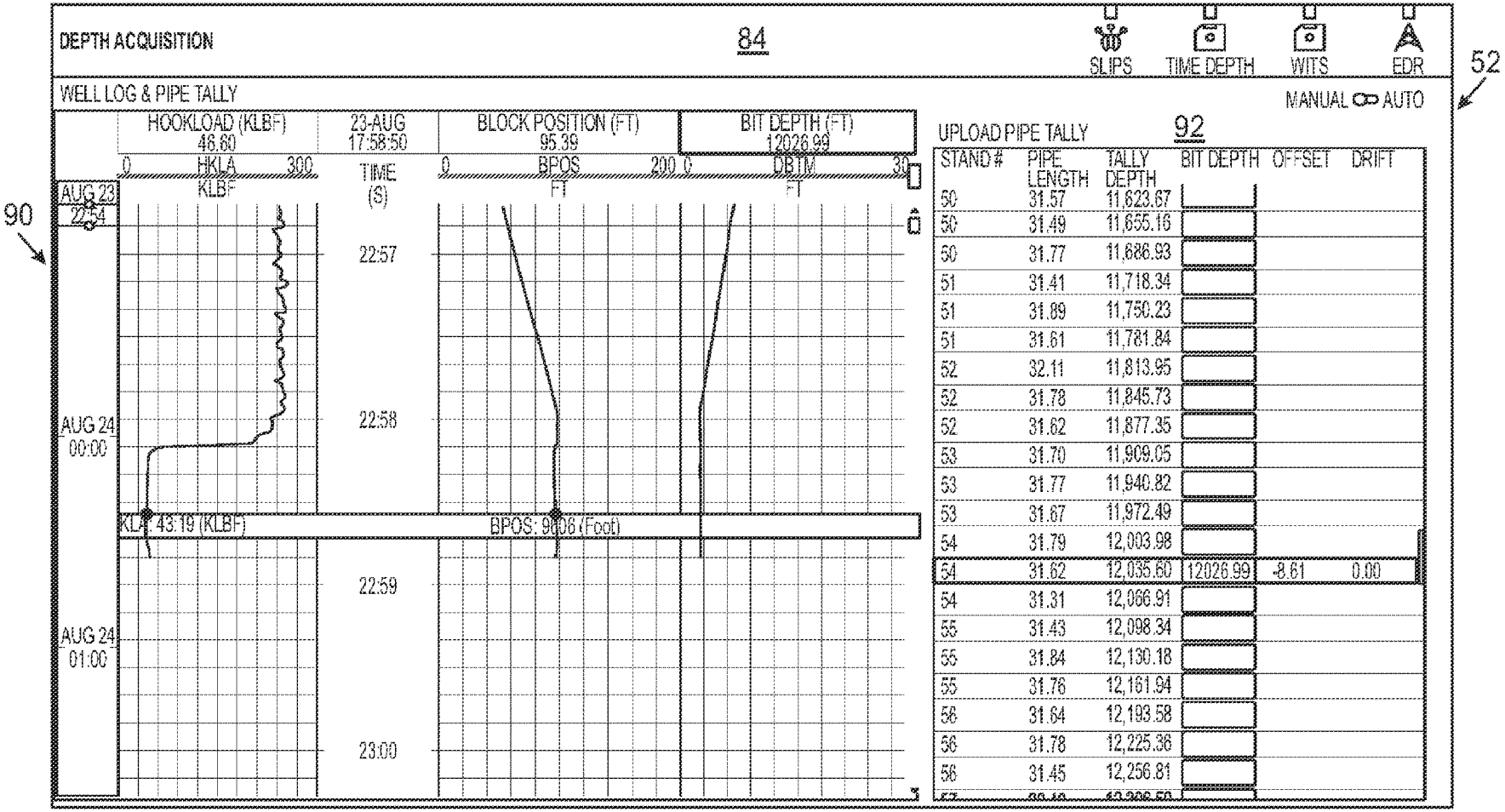
Figure 14:
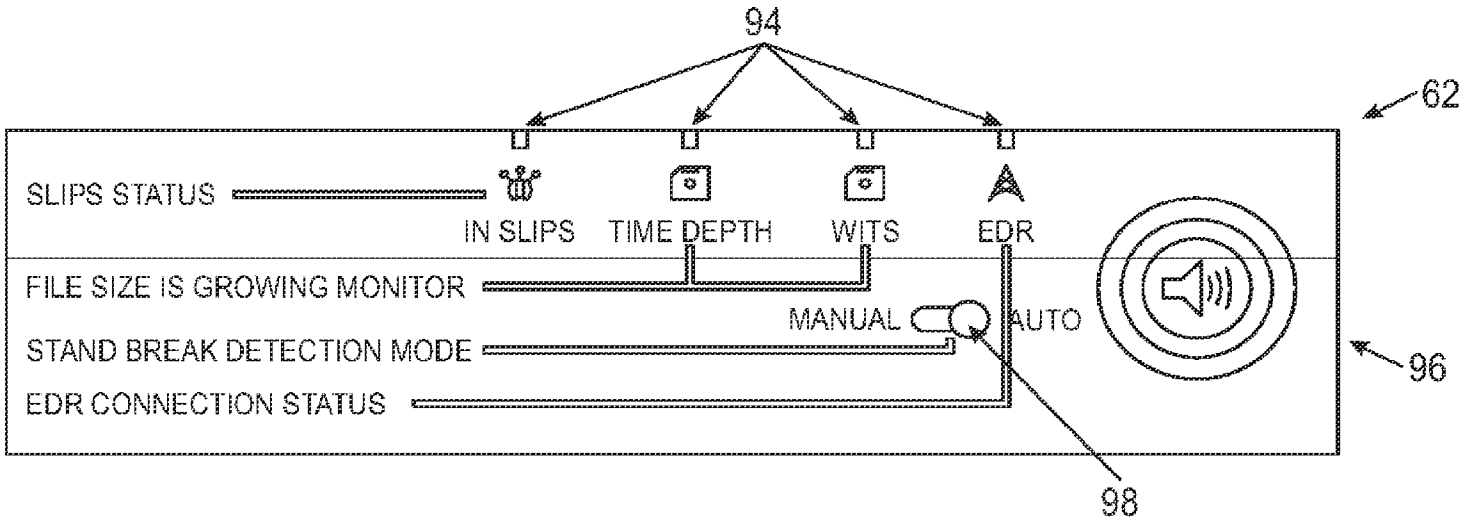

As illustrated in FIG. 13, in certain embodiments, once a connection is made to a third-party computer or loaded from a file for playback, the data may be streamed and displayed in a log pane 90, which is the main view for the Depth Acquisition workflow. In certain embodiments, the logs may be zoomed in and out and an automated stand break detection algorithm may populate the table with detected stand breaks. In certain embodiments, a pipe tally table 92 may auto-scroll to keep the latest auto-detected stand break in view. As illustrated in FIG. 14, in certain embodiments, when the depth acquisition view 84 is active, the toolbar 62 may display lights 94 that show the status of important measurements, such as: (1) a slips status, (2) when various file sizes are growing too large, (3) and an electronic data recorder (EDR) connection status, among other measurements. For example, in certain embodiments, the lights 94 may turn red when an alarm is triggered and, if an alarm is critical, audio cues (and, in certain embodiments, audio speech instructions) 96 may be played on the computer to alert the user and instruct them on how to address the alarm. In addition, as also illustrated in FIG. 14, in certain embodiments, the toolbar 62 may display a current stand break detection mode 98.

Data Quality Check

Figure 15:
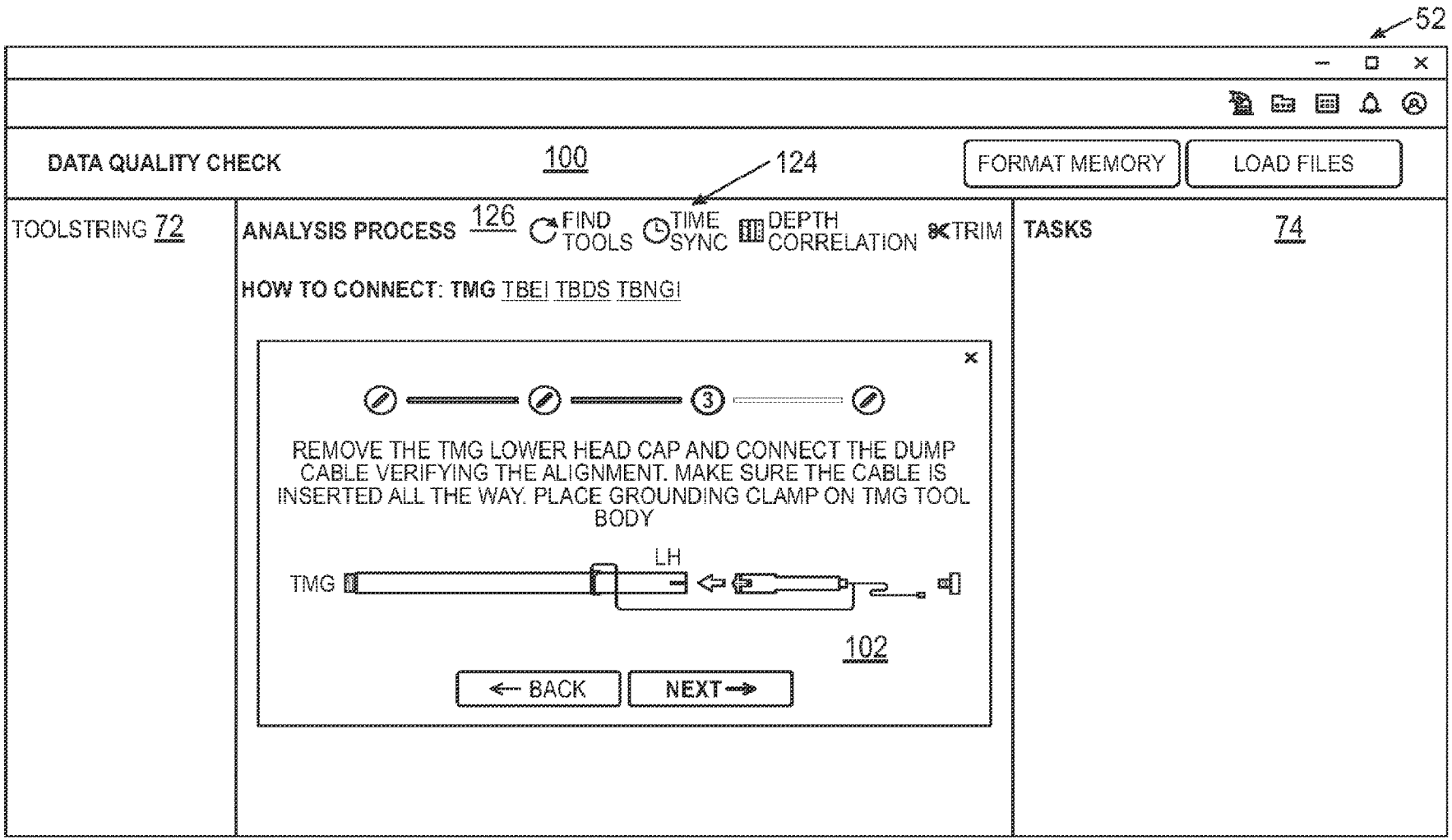
FIGS. 15-23 illustrate various views of a data quality check workflow that may be initiated from the dashboard view illustrated in FIG. 2, in accordance with embodiments of the present disclosure.
Figure 16:
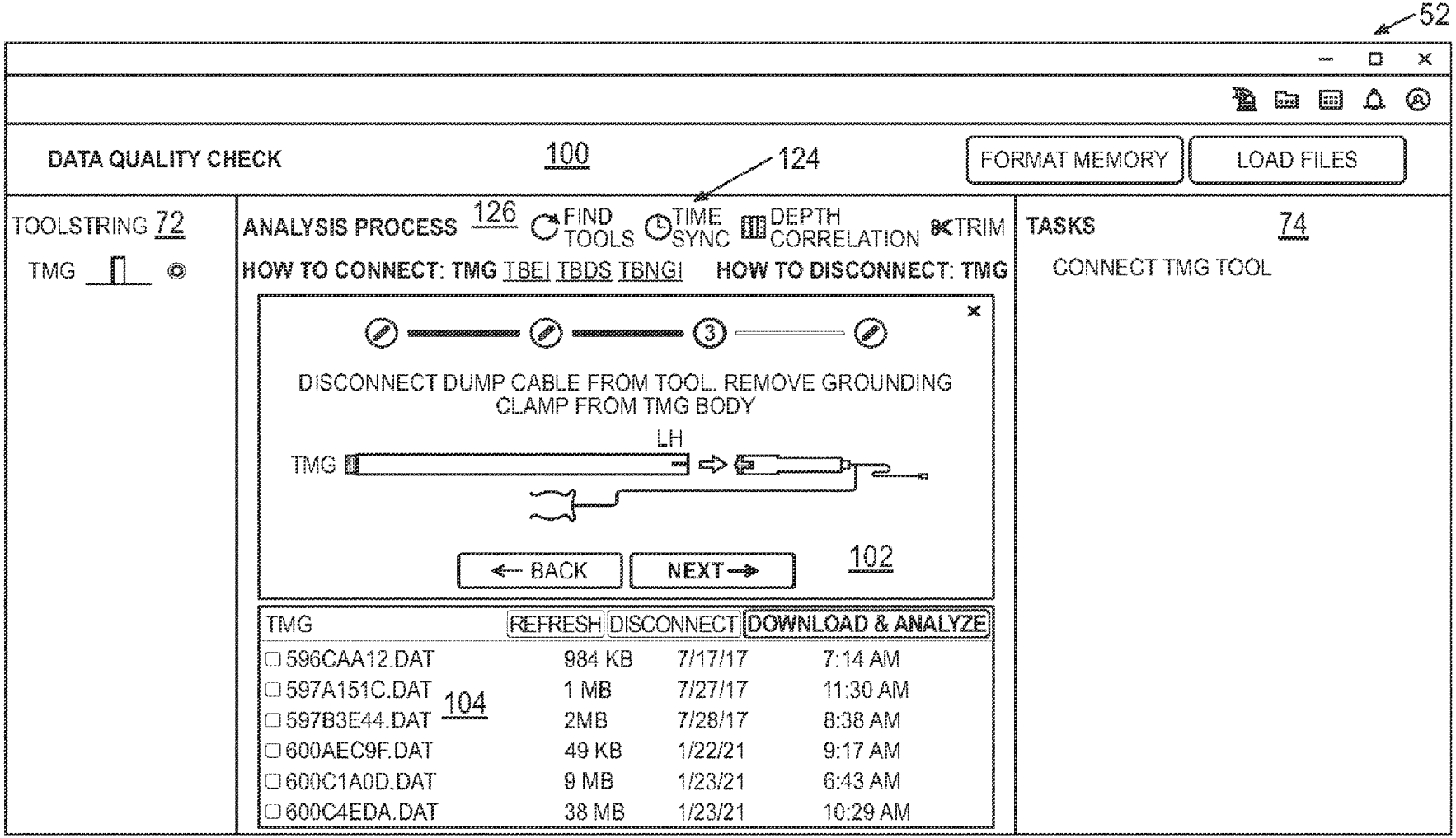

As illustrated in FIG. 15, if a user selects the data quality check 60 option from the dashboard view 54 illustrated in FIG. 2, in response, the graphical user interface 52 may present a data quality check view 100. As also illustrated in FIG. 15, in certain embodiments, the data quality check view 100 may first display dynamic SWIs in an SWI pane 102, which may instruct a user how to connect a dump cable to download DAT files from memory media of the downhole tools 36. As illustrated in FIG. 16, in certain embodiments, after the memory media of the downhole tools 36 are detected, a list of DAT files from the downhole tools 36 that are available for download may be shown in a file download pane 104. As also illustrated in FIG. 16, in such embodiments, the dynamic SWIs may update to show how to disconnect once download is complete.

Figure 17:
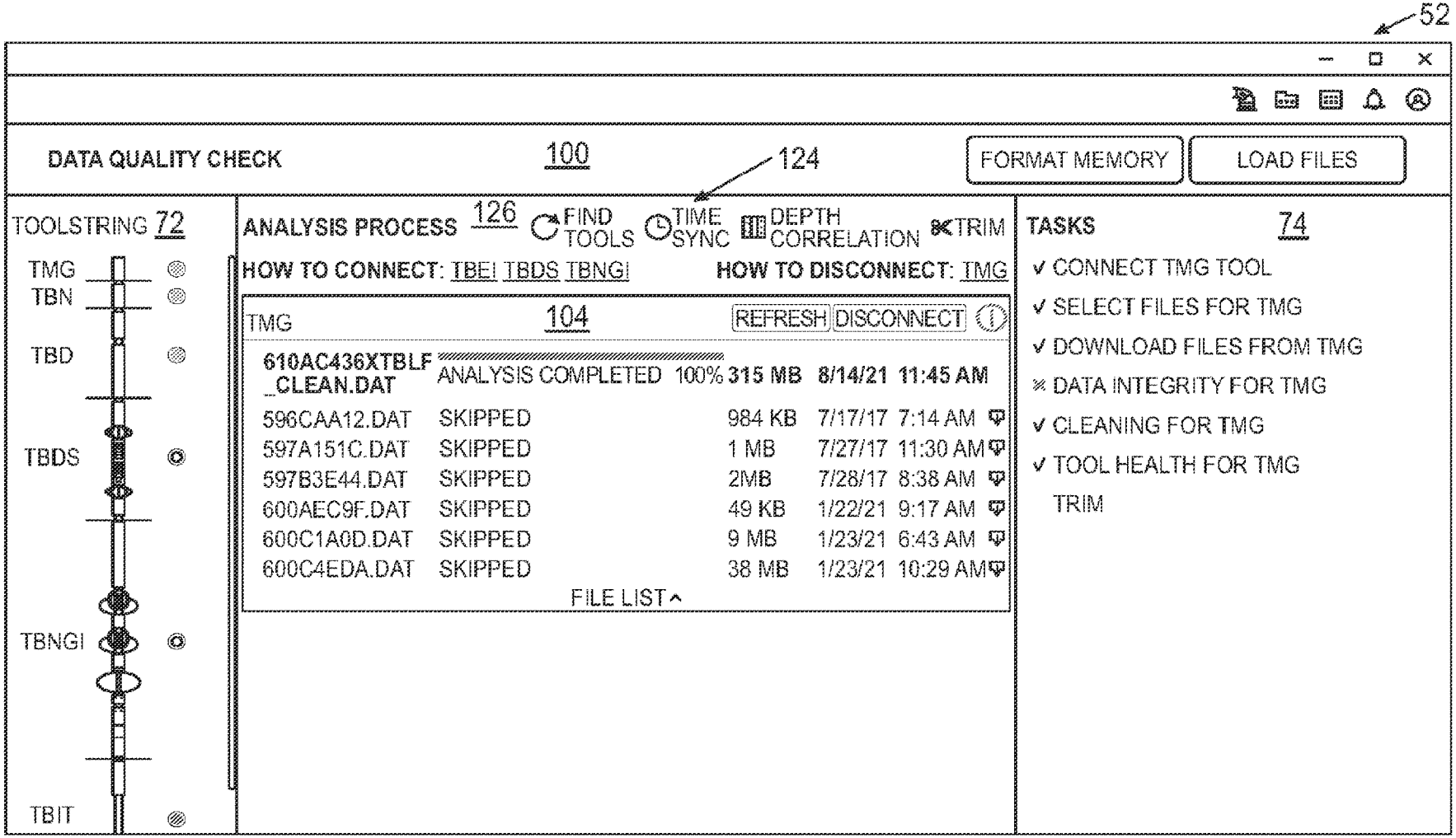

In addition, as illustrated in FIG. 17, in certain embodiments, one or more DAT files may be selected for download from the file download pane 104. In certain embodiments, downloads may be paused and re-started. In certain embodiments, file analysis may be performed automatically after download is complete. In addition, in certain embodiments, results of the analysis are shown per downhole tool 36 in the toolstring pane 72, for example, as green/red radio icons. In addition, in certain embodiments, the tasks pane 74 may show the automated tasks that are running or have completed with either pass or failed status, for example.

Figure 18:
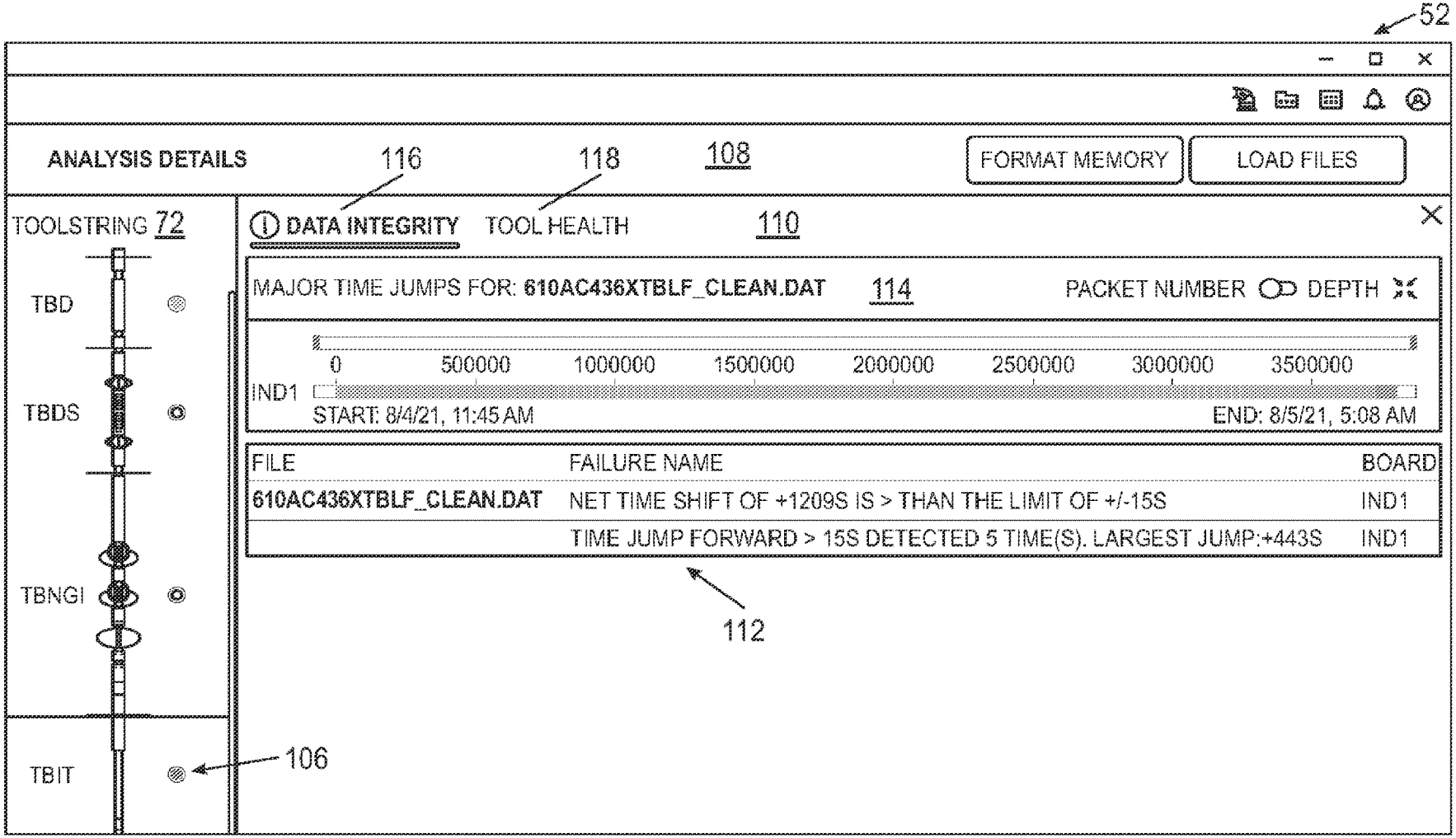

As illustrated in FIG. 18, in certain embodiments, downhole tools 36 with errors may have a red radio icon 106 shown in the toolstring pane 72 of an Analysis Details view 108. In certain embodiments, clicking on a tool picture associated with a particular downhole tool 36 in the toolstring pane 72 may open a data integrity/tool health pane 110 that includes a list 112 of failed tests and a graphical swim lane (e.g., a graphical line that is a visual representation of a time series, including various events represented by various colors) 114 showing the packet number where the errors were found. As also illustrated in FIG. 18, in certain embodiments, a user may click a Data Integrity tab 116 or a Tool Health tab 118 to view errors in each particular category.

Figure 19:
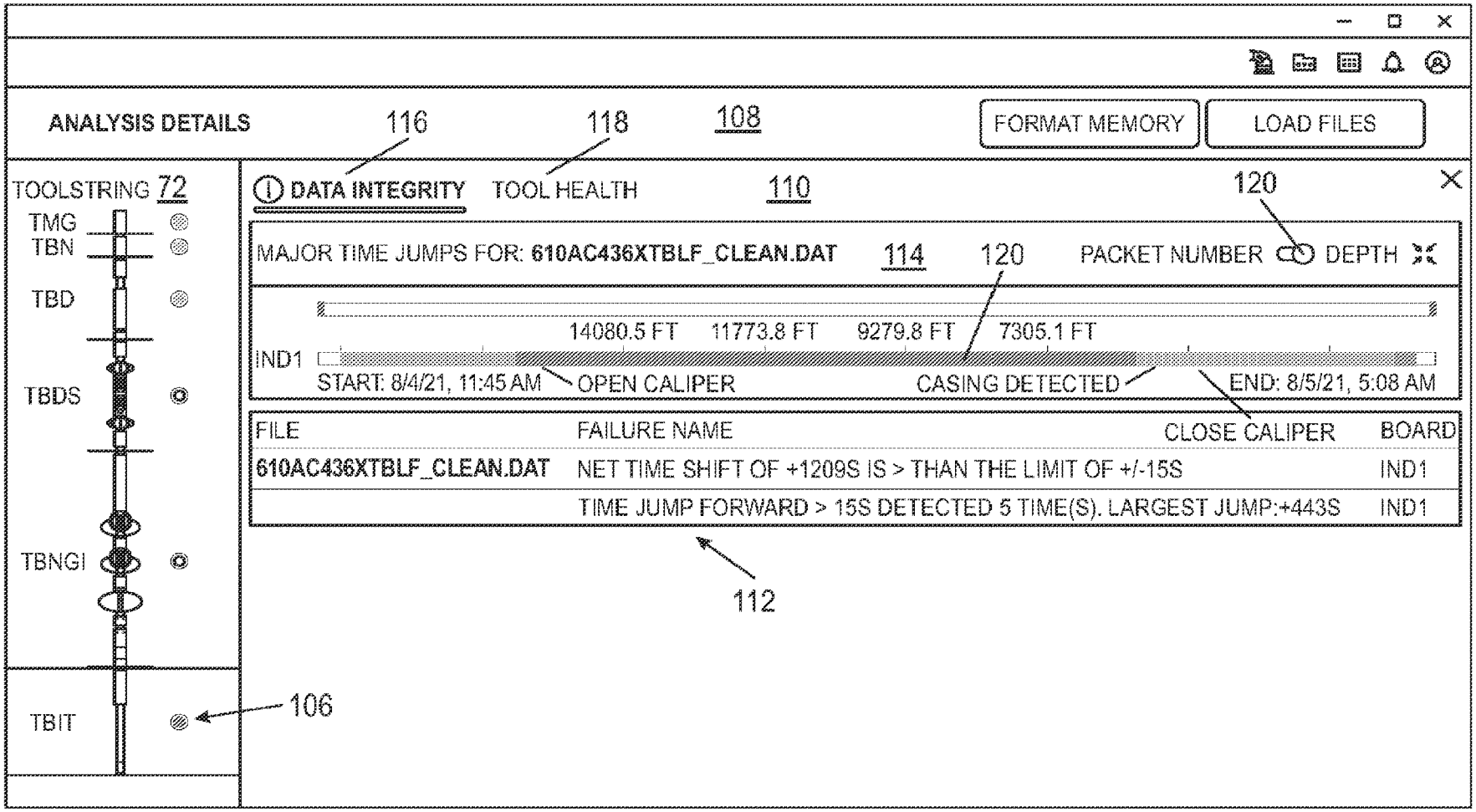

DAT files record all data while a downhole tool 36 was powered on beginning at the surface, running in hole, and pulling out of hole. However, users are often most interested in the depth interval in which a particular downhole tool 36 was logged in open hole, which is a subset of the full DAT file. As illustrated in FIG. 19, in certain embodiments, a toggle 120 may be available to run a computation to convert the DAT file time data to depth and switch the graphical swim lane 114 to display the interval of interest versus depth (e.g., as a depth overlay). This is represented in the blue region 122 of the graphical swim lane 114. In addition, in certain embodiments, important events (e.g., Open Caliper, Casing Detected, and Close Caliper, among other events) during the job may be detected and annotated on the graphical swim lane 114.

Figure 20:
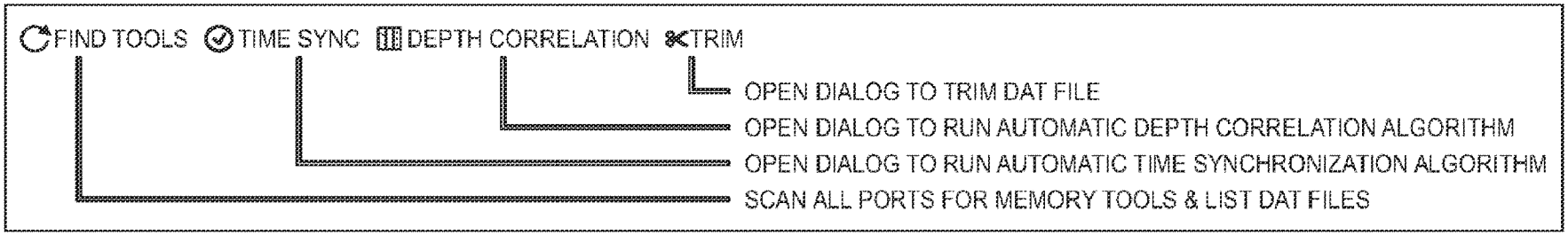
Figure 21:
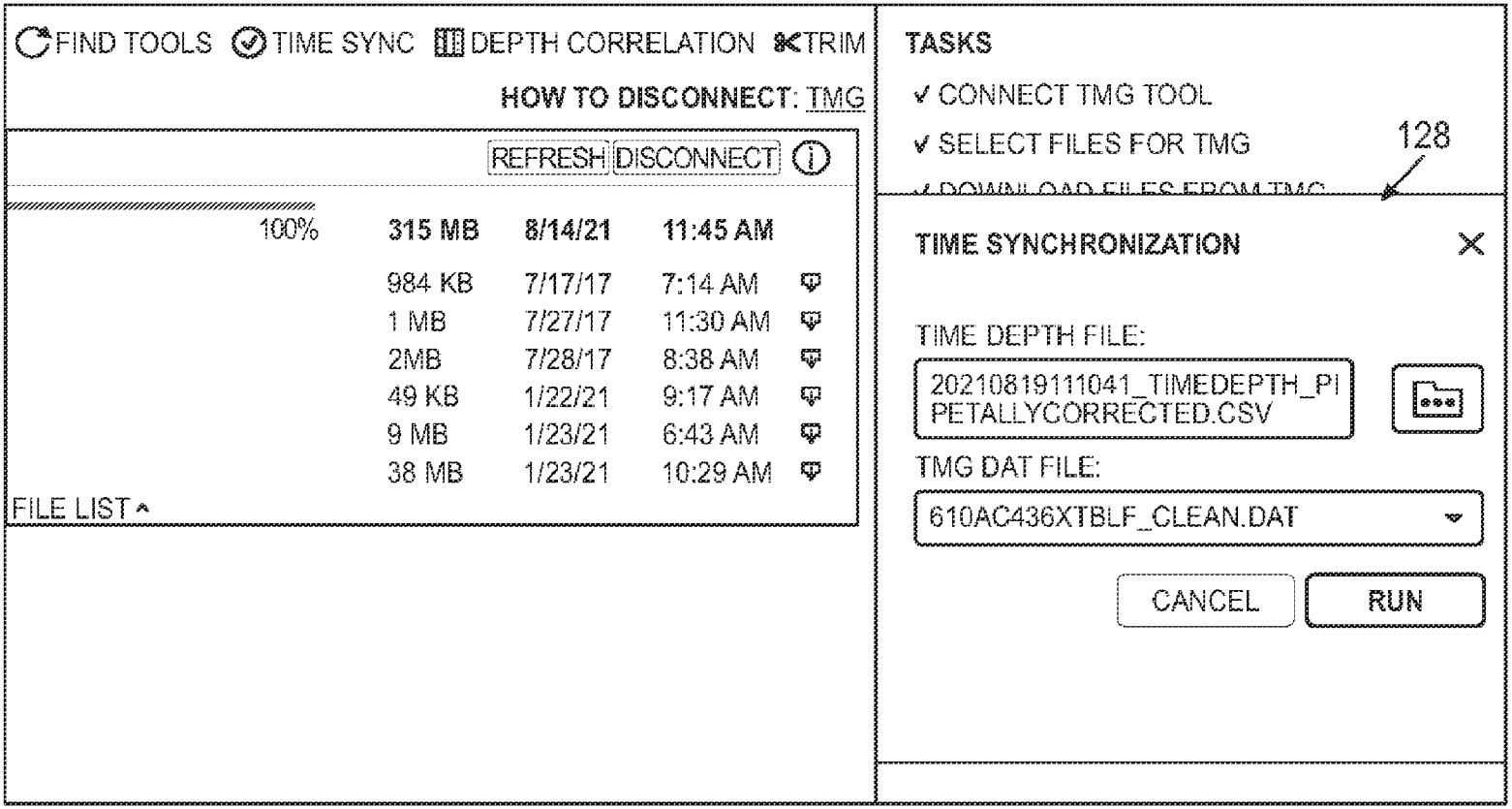
Figure 22:
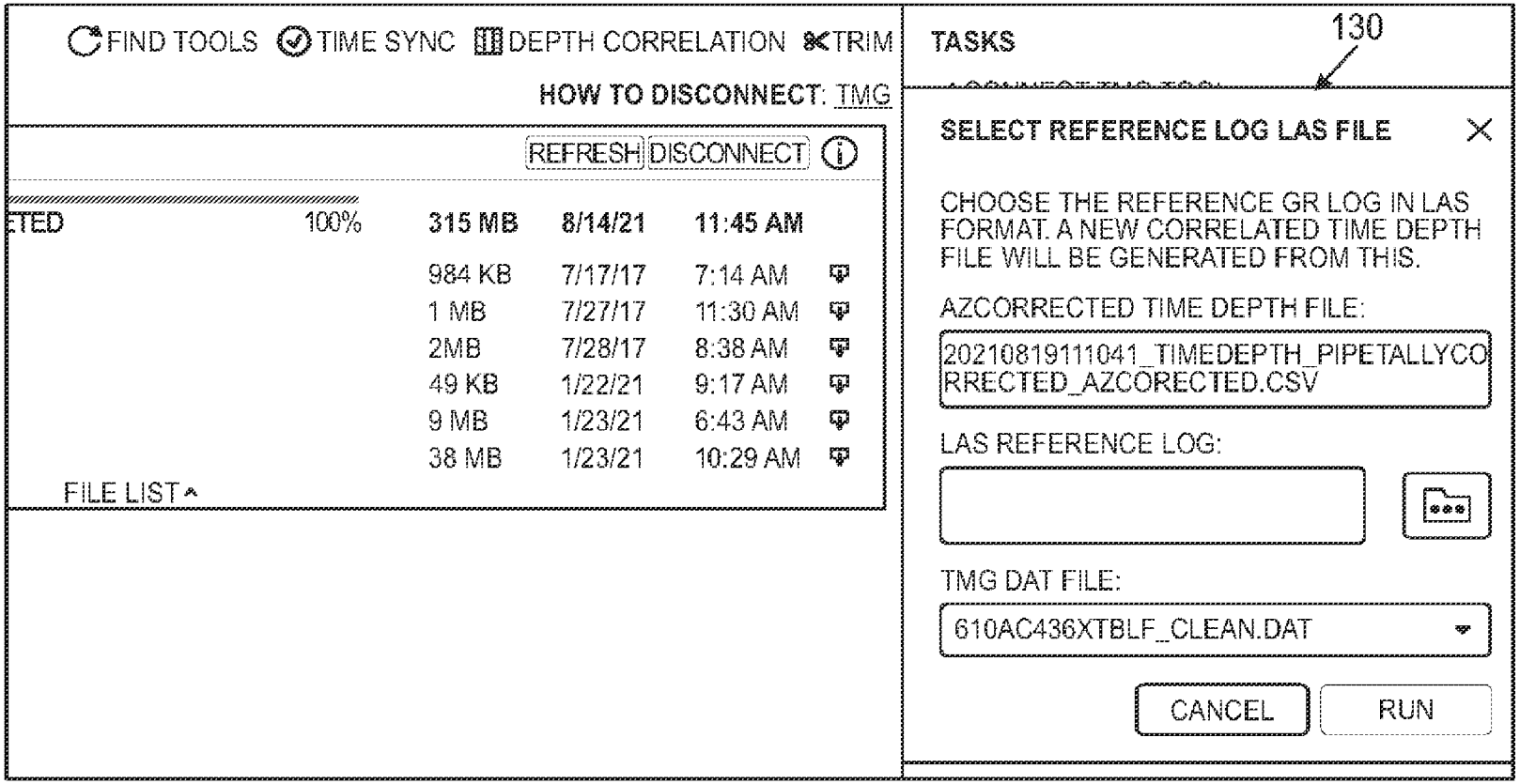
Figure 23:
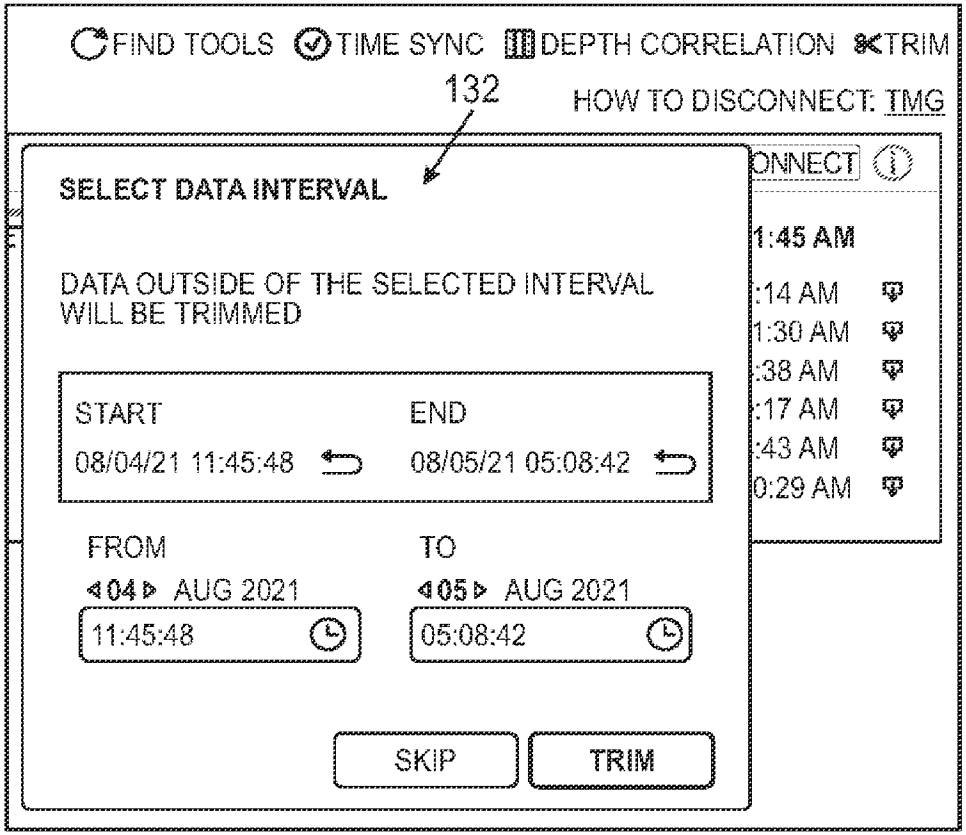

As illustrated in FIG. 20, in certain embodiments, a toolbar 124 in the top right hand corner of an Analysis Process pane 126 (e.g., that includes the SWI pane 102 and the file download pane 104, as illustrated in FIGS. 15-17) of the data quality check view 100 may enable a user to perform functions such as: (1) Find Tools (e.g., scan all ports for connected downhole tools 36 with memory media and list DAT files), (2) Time Sync (e.g., open a Time Synchronization dialog 128 to run an automatic time synchronization algorithm to synchronize files, such as a Depth file and a DAT file, as illustrated in FIG. 21), (3) Depth Correlation (e.g., open a Depth Correlation dialog 130 to run an automatic depth correlation algorithm, as illustrated in FIG. 22), and (4) Trim (e.g., open a File Trimming dialog 132 to enable a user to trim a DAT file, as illustrated in FIG. 23), among other functions. In certain embodiments, the File Trimming dialog 132 allows the user to trim the beginning and/or the end of loaded DAT files. In particular, the user enters the start and end timestamps where the trim should occur. The new trimmed DAT file may then be written to disk. In addition, in certain embodiments, the icons related to running automatic algorithms for automatic correction may turn different colors (e.g., green, yellow, or run) depending on the results of the particular algorithm.

Figure 24:
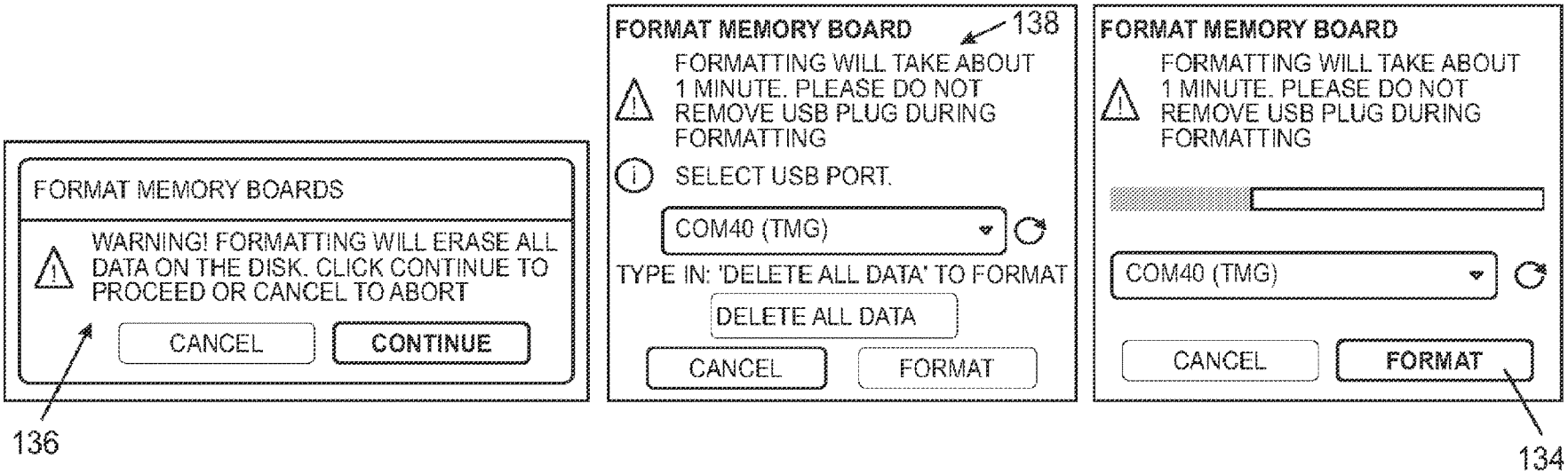
FIG. 24 illustrates various view presented to a user to enable formatting of memory media of a downhole tool.

As illustrated in FIG. 24, after all DAT files are downloaded and analyzed, a user may choose to format the memory of a downhole tool 36 in preparation for a next job. As illustrated, in certain situations, there may be several precautions to performing this non-recoverable operation. For example, after clicking a Format button 134, a warning 136 may be shown. After the user continues, a dialog 138 appears for the user to select a downhole tool 36, the memory for which will be formatted. In certain embodiments, before executing the formatting, the user may be required to type in "Delete all data" to confirm the operation.

The specific embodiments described above have been illustrated by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A method, comprising:

communicatively coupling to a memory media of a downhole tool; and providing, via a data processing system, a user interface to enable a user to manipulate data relating to downhole operations performed by the downhole tool, and to format the memory media of the downhole tool, wherein the providing the user interface comprises providing the user interface to enable the user to perform a pre-job surface check workflow for future downhole operations to be performed by the downhole tool.

2. The method of claim 1, wherein providing the user interface to enable the user to perform the pre-job surface check workflow comprises displaying dynamic standard work instructions relevant to the downhole tool to aid the user with physically connecting the downhole tool to the data processing system.

3. The method of claim 2, wherein the dynamic standard work instructions comprise drawings and descriptions integrated with steps that need to be performed by the user.

4. The method of claim 1, wherein providing the user interface to enable the user to perform the pre-job surface check workflow comprises displaying progress of one or more automated tests performed on components of the downhole tool.

5. The method of claim 1, wherein providing the user interface to enable the user to perform the pre-job surface check workflow comprises providing animated drawings and/or audio cues to enable the user to perform one or more manual tests on components of the downhole tool.

6. The method of claim 1, wherein providing the user interface further comprises providing the user interface to enable the user to perform a depth acquisition workflow for the data relating to the downhole operations performed by the downhole tool.

7. The method of claim 6, wherein providing the user interface to enable the user to perform the depth acquisition workflow comprises displaying a plurality of logs of data acquired by the downhole tool relative to depth within a wellbore.

8. The method of claim 1, wherein providing the user interface further comprises providing the user interface to enable the user to perform a data quality check workflow on the data relating to the downhole operations performed by the downhole tool.

9. The method of claim 1, wherein the downhole operations comprise through-the-bit drilling operations.

10. A method, comprising:

communicatively coupling to a memory media of a downhole tool; and providing, via a data processing system, a user interface to enable a user to manipulate data relating to downhole operations performed by the downhole tool, and to format the memory media of the downhole tool, wherein the providing the user interface comprises providing the user interface to enable the user to perform a data quality check workflow on the data relating to the downhole operations performed by the downhole tool by:

enabling the user to view data integrity of the data relating to the downhole operations performed by the downhole tool;

displaying a graphical line as a visual representation of the data relating to the downhole operations performed by the downhole tool;

enabling the user to perform an automatic time synchronization algorithm to synchronize files relating to the data relating to the downhole operations performed by the downhole tool;

enabling the user to perform an automatic depth correlation algorithm to correlate files relating to the data relating to the downhole operations performed by the downhole tool; or enabling the user to trim files relating to the data relating to the downhole operations performed by the downhole tool.

* * * * *